US008602686B2

(12) United States Patent
Aughton et al.

(10) Patent No.: US 8,602,686 B2
(45) **Date of Patent: *Dec. 10, 2013**

(54) UNDERSHOT SLUICE GATE

(71) Applicant: Rubicon Research Pty Ltd., Hawthorn (AU)

(72) Inventors: David John Aughton, Hawthorn East (AU); Damien Pearson, Kew East (AU)

(73) Assignee: Rubicon Research Pty Ltd., Hawthorn, Victoria (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/657,738

(22) Filed: Oct. 22, 2012

(65) Prior Publication Data

US 2013/0045051 A1 Feb. 21, 2013

Related U.S. Application Data

(63) Continuation of application No. 13/198,644, which is a continuation of application No. PCT/AU2010/000115, filed on Feb. 5, 2010, now Pat. No. 8,292,542.

(30) Foreign Application Priority Data

Feb. 5, 2009 (AU) ..... 2009900439
Feb. 5, 2010 (WO) ..... PCT/AU2010/000115

(51) Int. Cl.
*E02B 7/26* (2006.01)

(52) U.S. Cl.
USPC ..... 405/104; 405/87; 405/103; 405/106

(58) Field of Classification Search
USPC ..... 405/87, 88, 89, 90, 92, 103, 104, 105, 405/106
See application file for complete search history.

(56) References Cited

U.S. PATENT DOCUMENTS 5,577,863 A * 11/1996 Nottle ..... 405/87
5,967,697 A * 10/1999 Larsen ..... 405/104
7,083,359 B2 * 8/2006 Aughton et al. ..... 405/106

(Continued)

FOREIGN PATENT DOCUMENTS

FR 2585146 1/1987
JP 2006241861 9/2006

(Continued)

OTHER PUBLICATIONS

Search Report and Written Opinion mailed May 28, 2010 from International Serial No. PCT/AU2010/000115 filed Feb. 5, 2010.

*Primary Examiner* — Frederick L Lagman
(74) *Attorney, Agent, or Firm* — Sheppard, Mullin, Richter & Hampton LLP

(57) ABSTRACT

The invention provides an undershot sluice gate (17) to control flow of liquid through an open channel (10). The gate (17) includes a gate leaf (18) adapted to be raised and lowered by a control means (22) to allow flow of liquid along open channel (10). Gate leaf (18) has at least a pair of opposing liquid level sensors (44, 46) on, or in, gate leaf (18) to provide measurement of liquid level upstream and downstream of gate leaf (18). The sensors (44, 46) are located at a predetermined distance from the lowermost edge of gate leaf (18) to allow said measurements without disturbance from the fluid flow profile resulting from movement of liquid beneath the lowermost edge of gate leaf (18).

21 Claims, 13 Drawing Sheets

(56) References Cited

U.S. PATENT DOCUMENTS

| | | | | |
|---|---|---|---|---|
| 7,244,078 | B2 * | 7/2007 | Aughton et al. | 405/106 |
| 7,461,999 | B2 * | 12/2008 | Aughton et al. | 405/92 |
| 8,292,542 | B2 * | 10/2012 | Aughton et al. | 405/104 |

FOREIGN PATENT DOCUMENTS

| | | |
|---|---|---|
| WO | 0216698 | 2/2002 |
| WO | 2004018975 | 3/2004 |
| WO | 2008064421 | 6/2008 |

* cited by examiner

UNDERSHOT SLUICE GATE

CROSS-REFERENCE TO RELATED APPLICATIONS

This application is a continuation of U.S. patent application Ser. No. 13/198,644, filed Aug. 4, 2011 and entitled "Undershot Sluice Gate," now U.S. Pat. No. 8,292,542, which is a continuation of International Application No. PCT/AU2010/000115, filed Feb. 5, 2010 and published as WO 2010/088731 A1 and A9 on Aug. 12, 2010, entitled "Undershot Sluice Gate," which claims priority to Australian Patent Application Ser. No. 2009900439, filed Feb. 5, 2009, all of which are incorporated herein by reference.

FIELD OF THE INVENTION

This invention relates to an undershot sluice gate and relates particularly, though not exclusively, to an undershot sluice gate for irrigation channels.

DESCRIPTION OF THE PRIOR ART

In irrigation systems measurement of water levels for the purpose of flow measurement through an undershot sluice gate is required. The solution has been to locate water level instrumentation at a sufficient distance upstream and downstream of the sluice gate such that they are outside the turbulent velocity influenced region of the fluid flow. This problem has existed for over a century—the science of measuring flow through an undershot sluice gate is well established, but has been limited by the practicality of measuring the water level upstream and downstream of the sluice gate. This is presently achieved by mounting water level sensors at a minimum required distance upstream of the gate leaf and downstream of the gate leaf. There are three primary pieces of equipment which must be installed to provide flow measurement using the undershot sluice gate to minimise the disturbance upon the sensor readings caused by the flow profile of the fluid passing beneath the bottom tip of the sluice gate. Firstly, the sluice gate with elevation sensor and flow computer. Secondly, a water level sensor located upstream of the sluice gate, and thirdly a water level sensor located downstream of the sluice gate. The installation of this traditional sluice gate metering system requires the elevation of the water level sensors to be surveyed relative to the elevation of the gate tip for accurate flow measurement to be possible.

This installation process is expensive, complex, and time consuming.

OBJECTS OF THE INVENTION

It is an object of the present invention to provide an undershot sluice gate which provides better flow measurement therethrough.

A further object of the invention is to provide an undershot sluice gate which allows measurements on the gate rather than remote from the gate.

SUMMARY OF THE INVENTION

With these objects in view the present invention provides an undershot sluice gate to control flow of liquid through an open channel, said gate including a gate leaf adapted to be raised and lowered by a control means to allow flow of liquid along said open channel, said gate leaf including at least a pair of opposing liquid level sensors on, or in, said gate leaf to provide measurement of liquid level upstream and downstream of said gate leaf, said sensors located at a predetermined distance from the lowermost edge of said gate leaf to allow said measurements without disturbance from the fluid flow profile resulting from movement of liquid beneath said lowermost edge of said gate leaf.

Preferably said sensors include a liquid entry inlet located near said lowermost edge of said gate leaf.

In a practical embodiment each liquid entry inlet includes a filter to reduce fluctuations in measurements due to impurities entering said sensors. The sensors may include a vertically disposed chamber to allow for ultrasonic measurement of liquid height in said chamber. The chambers are located on the outer opposing faces of said gate leaf or located inside said gate leaf adjacent the opposing faces of said gate leaf.

In a further aspect of the invention there is provided an undershot sluice gate to control flow of liquid through an open channel, said gate including a gate leaf adapted to be raised and lowered by a control means within a gate frame, said gate leaf and/or gate frame having at least one upstream chamber and at least one downstream chamber each containing a liquid level sensor to provide measurement of liquid levels upstream and downstream of said gate leaf, each chamber being sealed with a single liquid entry inlet located in a position to avoid disturbance from the fluid flow profile resulting from movement of liquid beneath said gate leaf.

BRIEF DESCRIPTION OF THE DRAWINGS

In order that the invention may be more readily understood and put into practical effect, reference will now be made to the accompanying drawings, in which.

DESCRIPTION OF THE PREFERRED EMBODIMENTS

Figure 1:
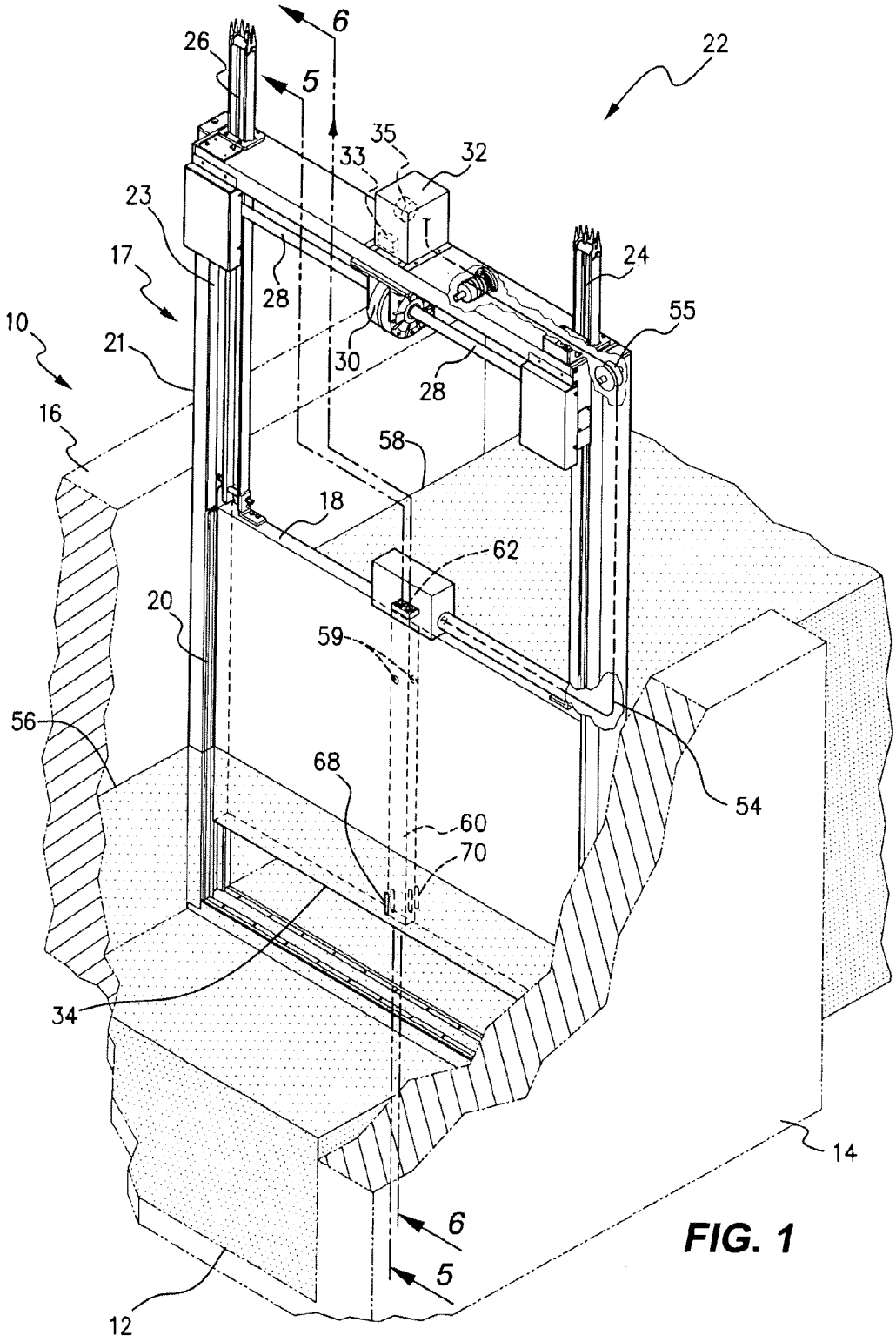
FIG. 1 is a perspective view of a first embodiment of an undershot sluice gate made in accordance with the invention shown fitted to an irrigation channel together.

In FIGS. 1 to 8 of the drawings there is shown an irrigation channel 10 having a floor 12 and sides 14, 16. The irrigation channel 10 is typically for delivery of water for agriculture but the channel can be used for other purposes where flow control of water is required. A control gate 17 allows a controlled flow of water therethrough. The control gate 17 includes a gate leaf 18 which slides within a frame 20. Frame 20 has an outer frame 21 which is permanently secured to floor 12 and sides 14, 16 of irrigation channel 10 and a constraining frame 23 which slides within outer frame 21. The constraining frame 23 may be connected to and separated from the mating frame with no requirement to undertake civil works on the floor 12 and sides 14, 16 of the irrigation channel 10. Alignment holes 25 can be provided to provide correct alignment by insertion of location pins (not shown). This type of internal/external frame mechanism is further detailed in the specification of International Patent Application No. PCT/AU01/01036, the contents of which are herein incorporated. Gate leaf 18 is raised and lowered by a lifting mechanism 22. In this embodiment the lifting mechanism 22 has a pair of tensioned cables 24, 26 which co-operate with a corresponding pair of spools 27 attached at each end to a rotatable shaft 28. This assembly is also disclosed in International Patent Application No. PCT/AU01/01036. Shaft 28 is rotated by motor 30 through a controller 32. An encoder 35 measures the incremental rotational movement of shaft 28. This rotational measurement is translated to a precision measurement of gate tip elevation relative to the bottom surface of the constraining frame 23 by the controller 32. In the present embodiment of the invention, the gate tip elevation is measured relative to the bottom surface of the constraining frame 23 to an accuracy better than ±0.5 mm. The movement of shaft 28 is controlled by controller 32 to move the lowermost edge 34 of the gate leaf to a required elevation. Cables 24, 26 are rigidly attached to both ends of linear cable guide channels. The lower end of each cable guide channels is secured to the gate leaf 18 and at the other end to a block 29. As shaft 28 is rotated, the resultant rotation of cable spools 27 results in a vertical translation of the ends of the cables 24 and 26. The vertical translation of the ends of cables 24 and 26 in turn results in a vertical translation of the cable guides and subsequently results in vertical translation of the gate leaf 18. The controller 32 eliminates measurement uncertainty contributed by backlash or play in the drive system components (motor, gearbox, cables) by always moving the lowermost edge 34 of the gate leaf 18 to a required elevation in a downwards lowering direction. If the lowermost edge 34 gate leaf 18 is to be raised to a required position above its present position, then the controller 32 will raise the gate leaf 18 above the required position, and then lower the gate leaf 18 to the required position. In this manner, any play or backlash in the drive system is eliminated, allowing consistent positioning accuracies on the order of ±0.5 mm.

Controller 32 can be remotely controlled from a wired or wireless connection through computer control 33. The lifting mechanism is not limited to the use of tensioned cables 24, 26 illustrated, as it could also include a rack and pinion drive, hydraulic drive or any other suitable mechanism to allow the raising and lowering of gate leaf 18. The use of a rack and pinion drive is shown in the specification of Australian Patent Application No. 2009900439 which has been published with the specification of this application. The contents of Australian Patent Application No. 2009900439 are herein incorporated. The raising of gate leaf 18 from its closed position at the bottom of its travel provides a gap between floor 12 and the lowermost edge 34 of gate leaf 18 to allow water to pass through the gap.

The invention is not restricted to the control gate 17 shown in the embodiments as any suitable arrangement may be substituted.

The invention relates to the flow measurement through control gate 17 using measurements of the gate leaf elevation relative to floor 12 and the water level upstream and downstream of gate leaf 18. The water level is measured within sealed chambers which are contained within the gate assembly with respective liquid entry inlets located a predetermined distance from the lowermost edge of gate leaf 18. The measurement chambers are located on opposing sides of the gate leaf 18. A slot 60 is provided in the gate leaf 18 to allow insertion of a housing 62. Housing 62 has a pair of bores 64, 66 into which slide sensor assemblies 44, 46. The lowermost end of housing 62 is isolated by seal 47 to prevent ingress of water. Adjacent the lowermost end of housing 62 is a pair of inlets 40, 42 to allow water to enter housing 62. Slots 68, 70 are provided in the front and rear faces of gate leaf 18 to be aligned with inlets 40, 42 of housing 62 and inlets 48 of sensor assemblies 44, 46. Accordingly, gate leaf 18 will be very smooth on its front and rear faces except for slots 68, 70. The inlets are positioned at a predetermined distance from the lowermost edge 34 of gate leaf 18 to allow measurements to be taken in a non turbulent zone without disturbance from the fluid flow profile resulting from movement of water beneath gate leaf 18. The sensor assemblies 44, 46 located in housing 62 measure the height of the water in the respective sensor assemblies. Each assembly 44, 46 has an inlet 48 which is aligned with inlets 40, 42 of housing 62 to allow entry of water therein to fill the measurement chambers 47A, 47B. A mesh filter 43, 45 can be fitted to inlets 40, 42 or inlets 48, or to all the inlets to provide filtered water into assemblies 44, 46. This will reduce contamination and provide better measurement accuracy. The use of filtered measurement chambers 47A, 47B also means that the water levels may be accurately measured within a controlled environment which is not effected by temperature gradients, debris, trash, or other field disturbances. At the top end of each assembly 44, 46 is fitted an ultrasonic transducer 50, 52 which is connected to controller 32 by cable 54. Cable 54 is protected by being located within U-shaped frame 20 and sheath 51 on top of gate leaf 18 to connection box 53. Cable 54 is directed upwardly and guided by pulley 55 to be wrapped around a spring loaded pulley 57 which includes a slip ring contact before being coupled to controller 32. The sensors can be of the type disclosed in International Patent Application No. PCT/AU2007/001839 (the contents of which are herein incorporated) or other suitable substitute. Breather holes 59 are provided to prevent any air lock forming inside each assembly 44, 46. The ultrasonic transducers 50, 52 will allow determination of the height of the water level in assemblies 44, 46 and this information can provide feedback to the computer control for operational analysis.

Figure 5:
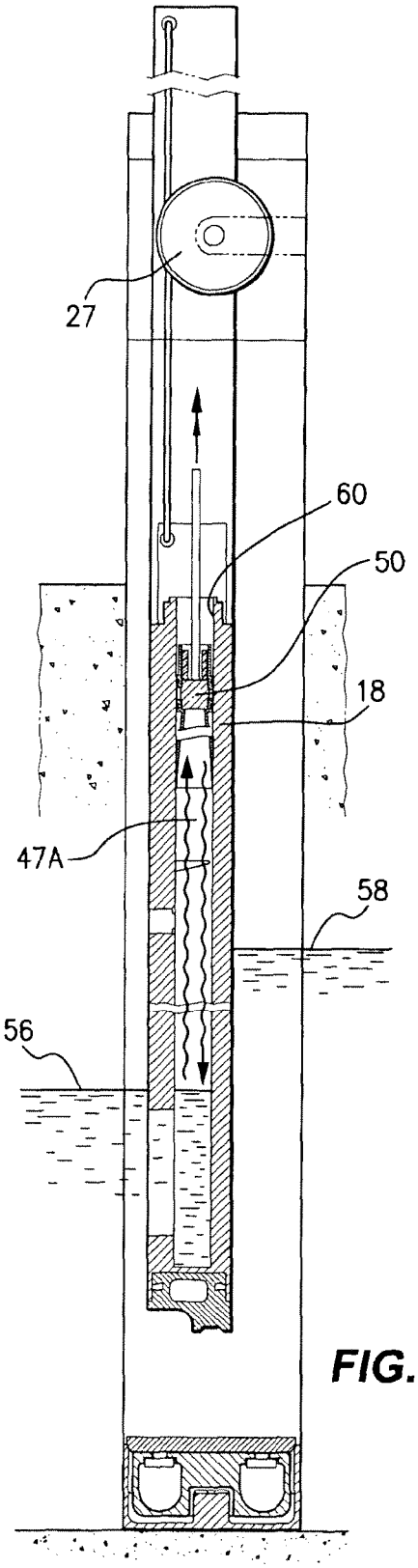
FIG. 5 is a longitudinal cross-sectional view along and in the direction of arrows 5-5 shown in FIG. 1.
Figure 6:
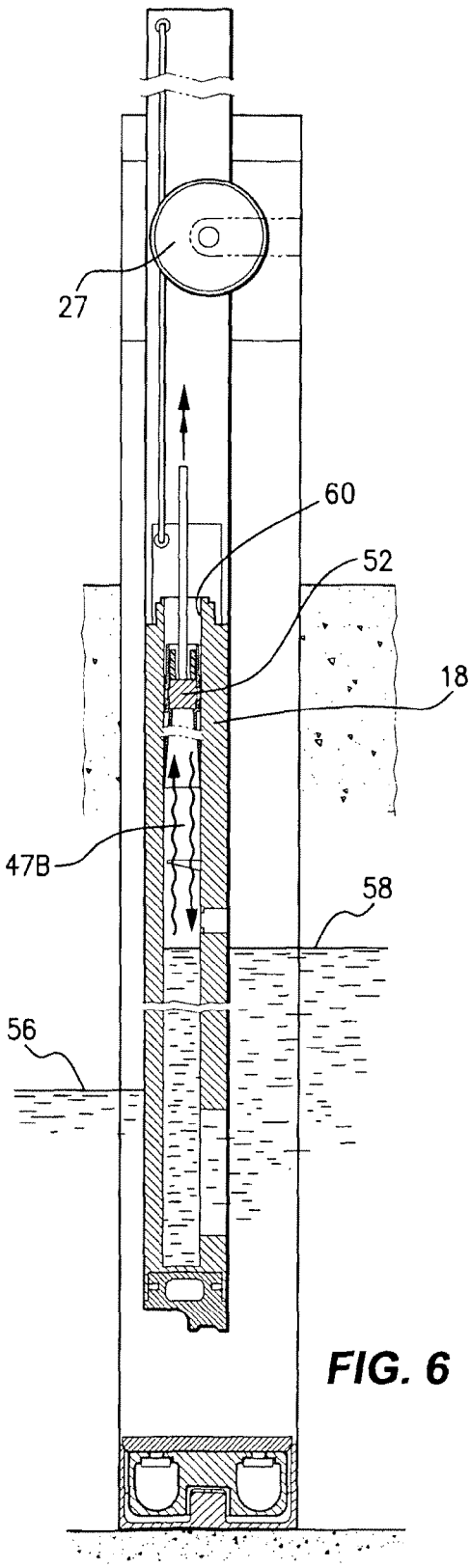
FIG. 6 is a longitudinal cross-sectional view along and in the direction of arrows 6-6 shown in FIG. 1.
Figure 7:
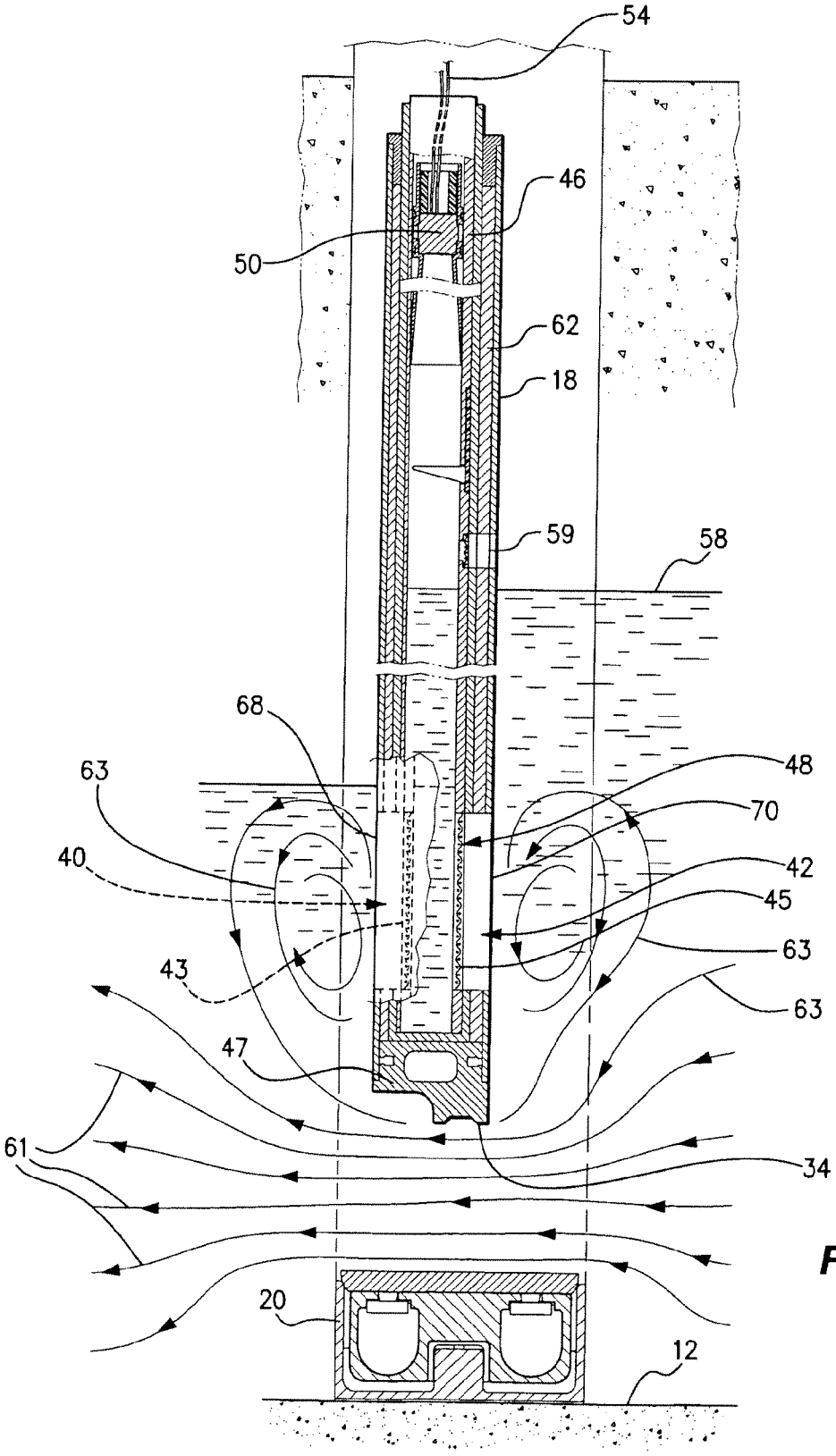
FIG. 7 is a longitudinal cross-sectional view of the gate shown in FIG. 1.
Figure 8:
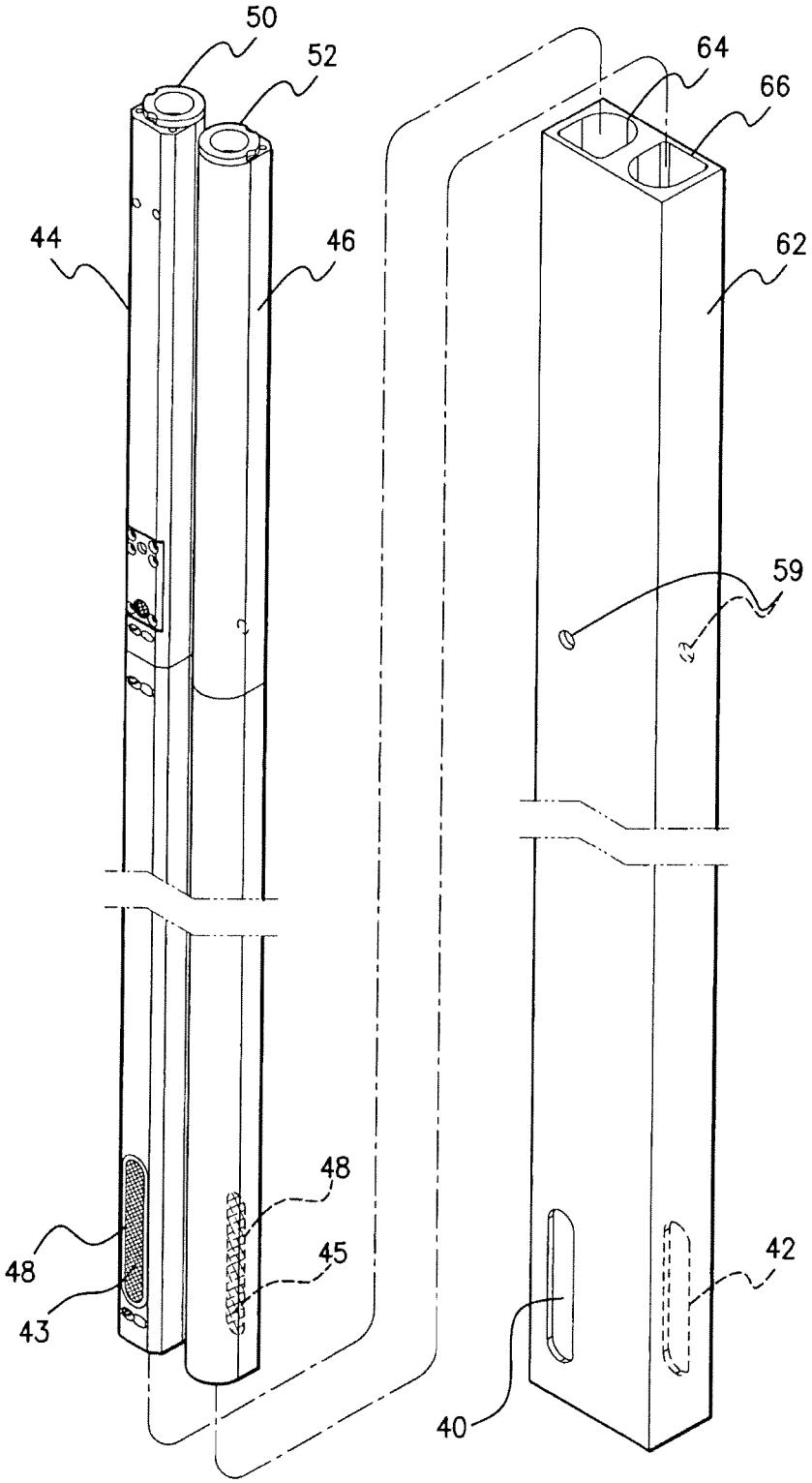
FIG. 8 is an exploded perspective view of the housing and sensor assemblies contained in the gate leaf of the undershot sluice gate shown in FIG. 1.
Figure 9:
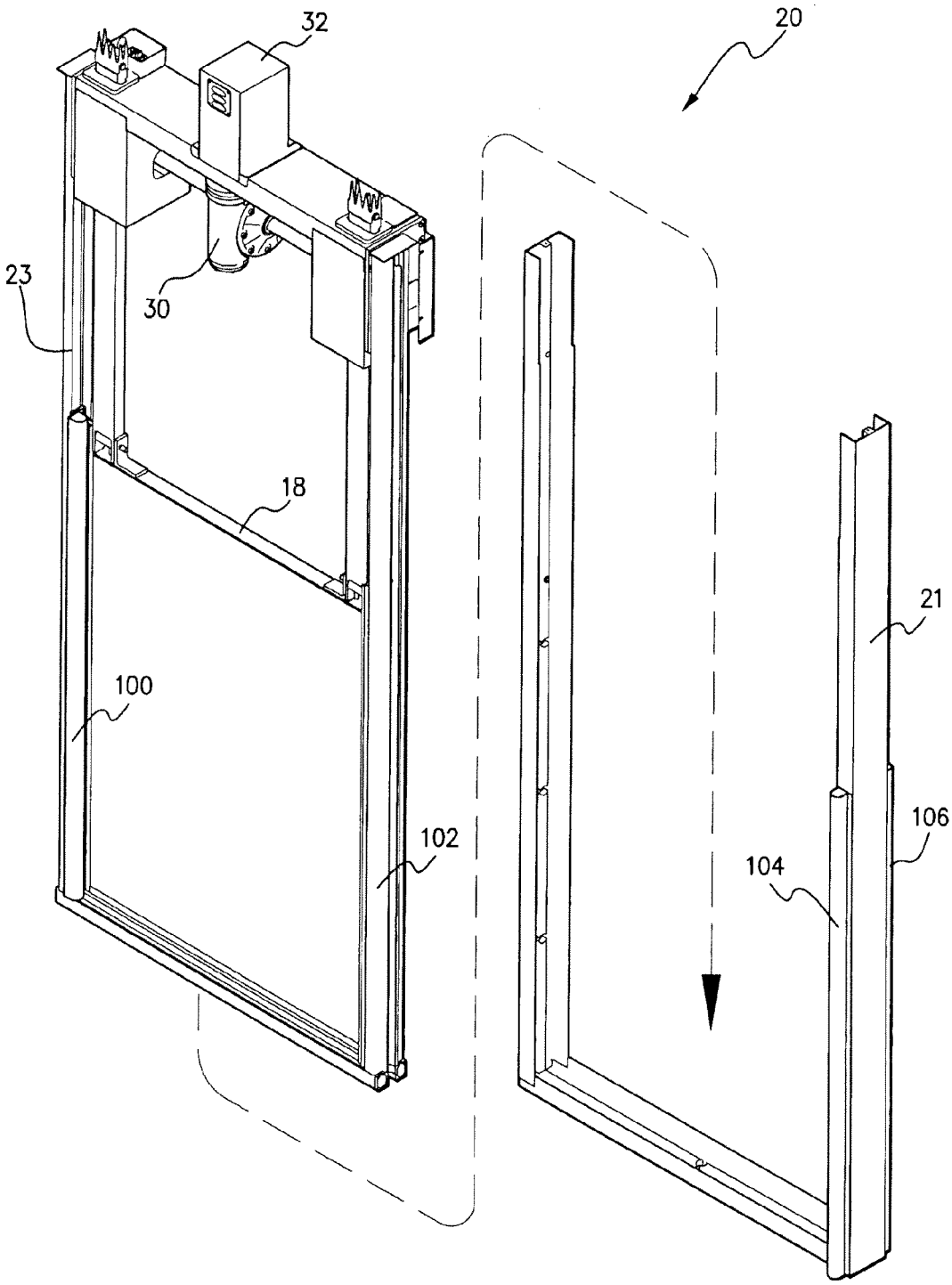
FIG. 9 is an exploded perspective view of second embodiment of an undershot sluice gate made in accordance with the invention.
Figure 10:
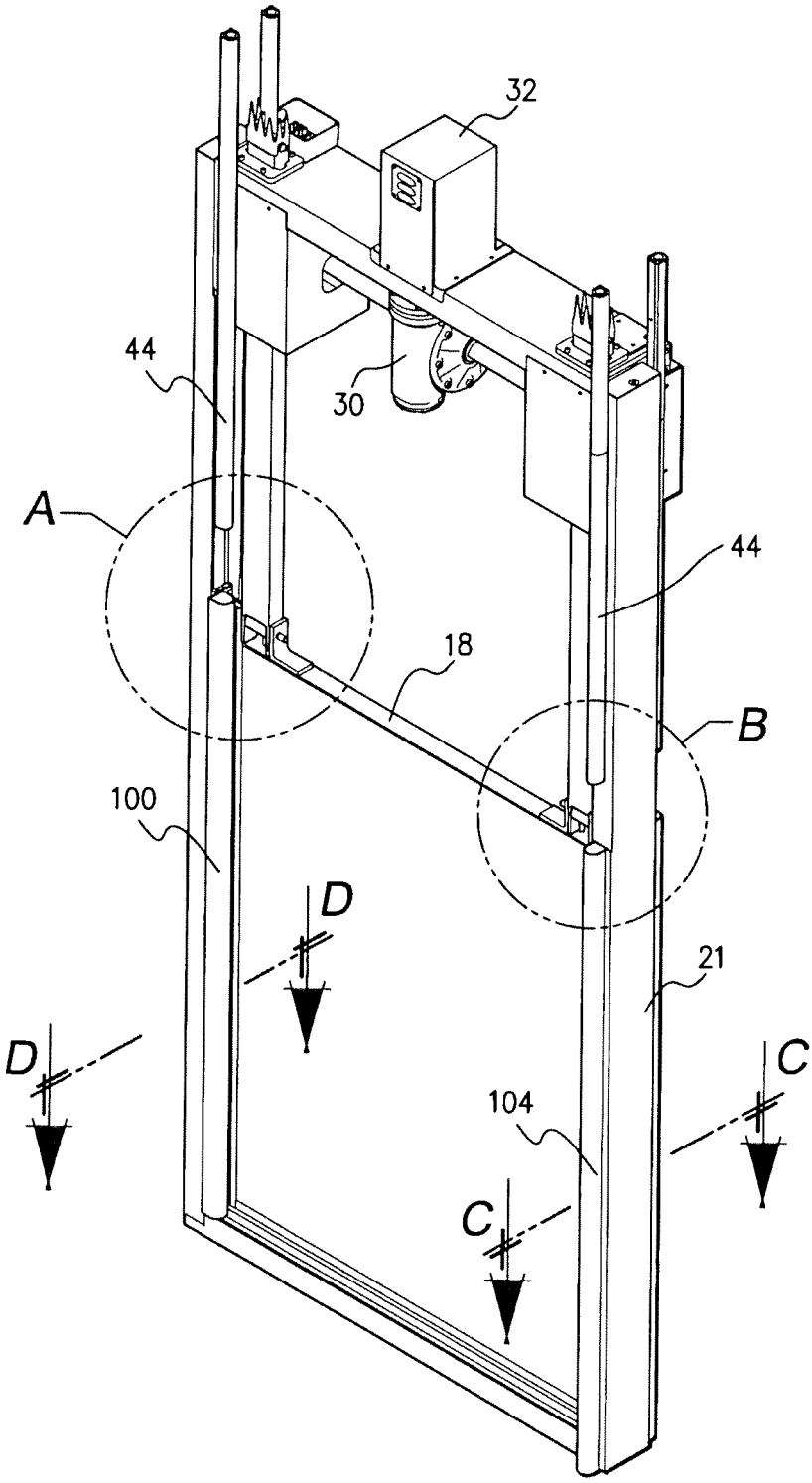
FIG. 10 is an assembled view of the gate shown in FIG. 9 with the sensor assemblies being mounted into the gate frame.
Figure 12:
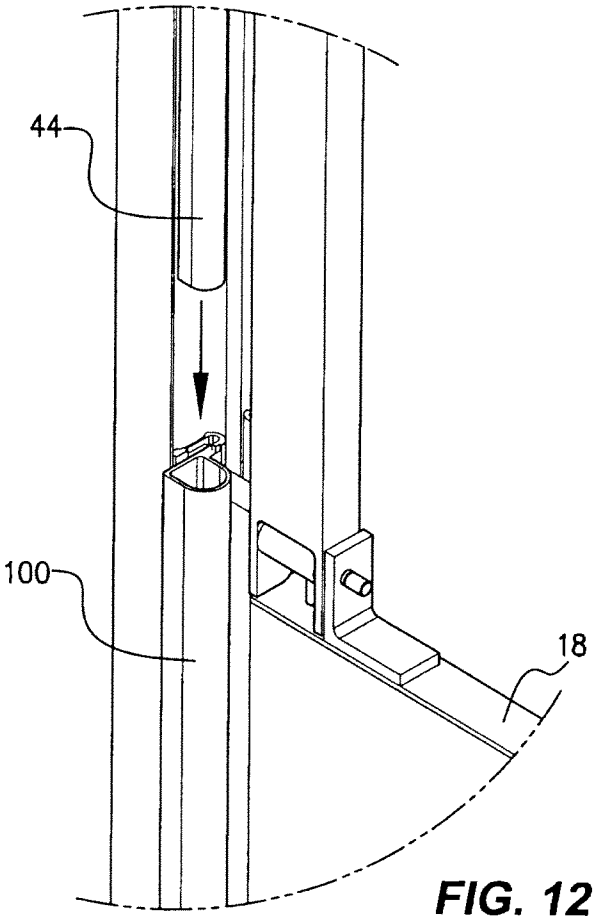
FIG. 12 is an enlarged view of the circled area labelled A in FIG. 10.
Figure 11:
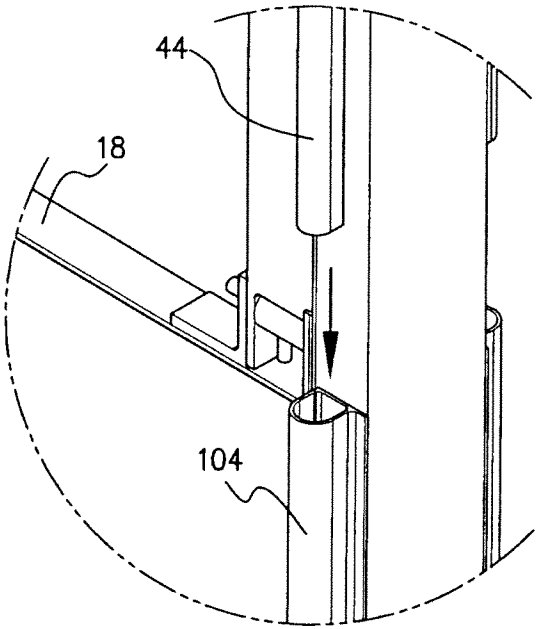
FIG. 11 is an enlarged view of the circled area labelled B in FIG. 10.
Figure 13:
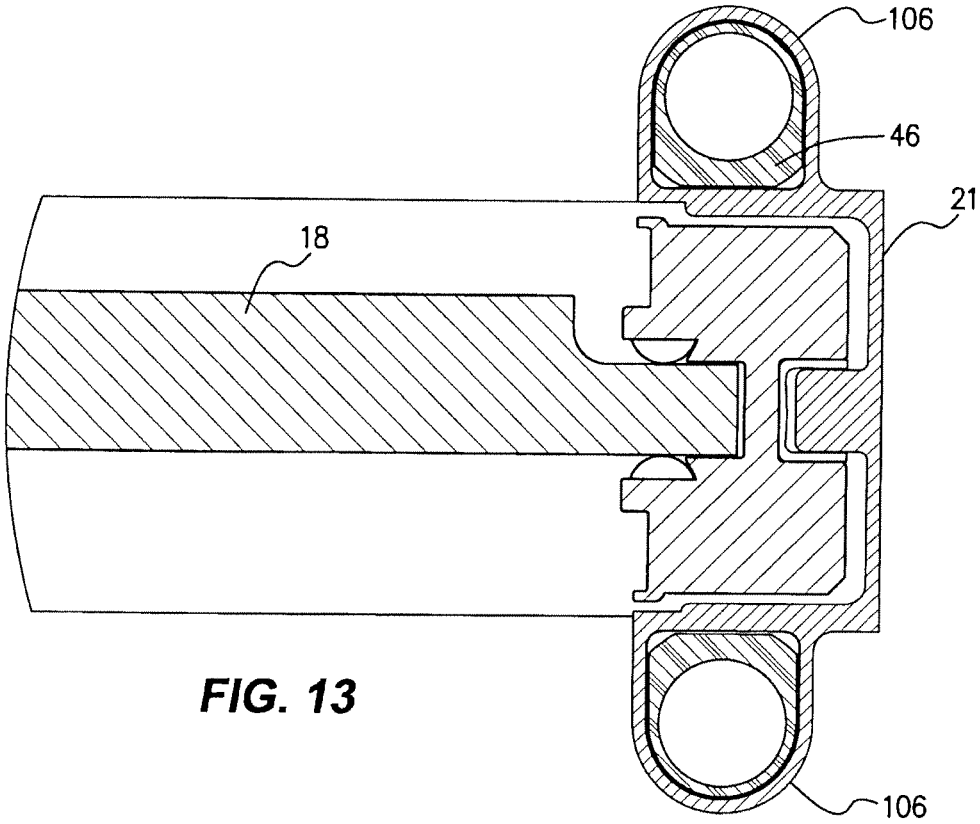
FIG. 13 is cross-sectional view along and in the direction of arrows C-C shown in FIG. 10 with the outer frame shown hatched.
Figure 14:
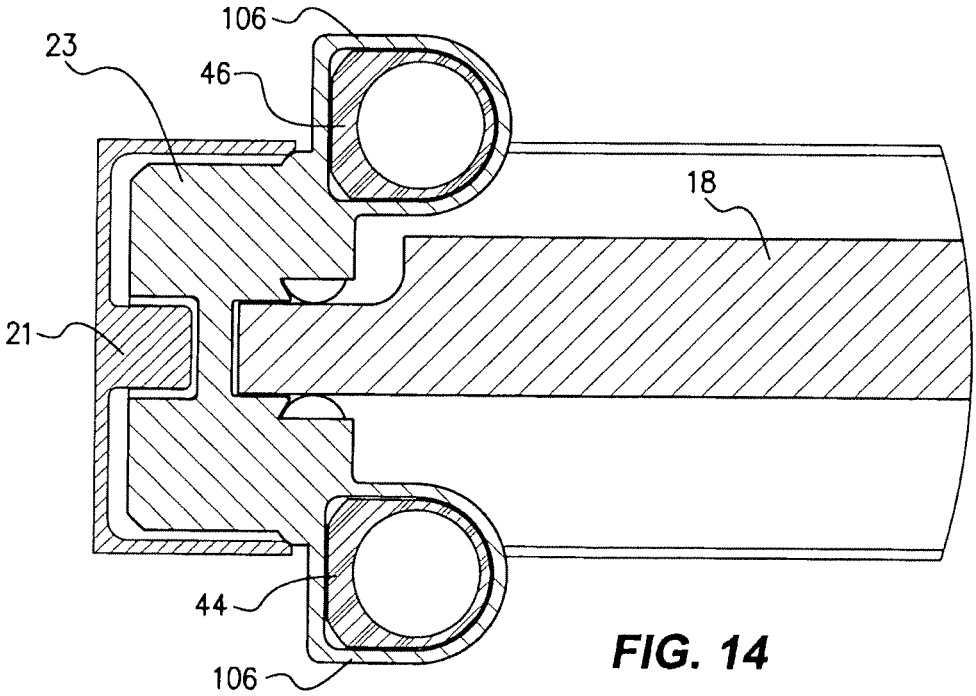
FIG. 14 is cross-sectional view along and in the direction of arrows D-D shown in FIG. 10 with the inner frame shown hatched.

In use, water will enter the assemblies 44, 46 and reach the same level as the water upstream and downstream of gate leaf 18. FIGS. 5, 6 and 7 show the respective levels 56, 58 which are measured by the ultrasonic transducers 50, 52. The height of the water within assemblies would normally be affected by velocity drawdown induced by the velocity of water passing beneath gate leaf 18. By locating the filtered water level measurement inlets at a fixed and constant distance above the bottom of gate leaf 18, it is ensured that the water entry point is always located in a zero mean velocity fluid region such that the velocity drawdown of water passing beneath gate leaf 18 does not affect the measurement of water level. The positioning of the inlets 40, 42 can be determined by analysis of flow patterns to determine the exact location above the lowermost edge of gate leaf 18. FIG. 7 shows the flow paths 61 beneath gate leaf 18 and flow paths 63 show the turbulence caused by water moving through the gap. The flow paths 61, 63 confirm that inlets 40, 42 are positioned in the zero mean velocity fluid region. By locating housing 62 and their associated sensor assemblies 44, 46 inside gate leaf 18 the maintenance is reduced and a gate leaf 18 with smooth front and rear surfaces results. In the embodiment the housing 62 and the associated sensor assemblies 44, 46 have been integrated into a single package but they could also be separated, if required.

The invention integrates the water level measurement into gate leaf 18 so that the flow metering gate may be installed as a single unit with no requirement for elevation surveys to be performed during the flow meter commissioning phase. The invention also reduces the space required for the flow meter to measure accurately, as it eliminates the water approach and exit length requirements of the existing water level sensor locations. Integration of multiple components into a single component reduces the cost and time of installation of the flow meter. The accuracy of flow measurement is also improved because a more accurate water level measurement can be obtained in the filtered measurement environment provided. This invention solves the problem of measuring the water level upstream and downstream of the sluice gate with sufficient accuracy to enable accurate determination of the fluid flow passing through the gate aperture.

Other embodiments will now be described. In order to avoid duplication of description the same reference numerals have been used for similar integers of the embodiment shown in FIGS. 1 to 8.

Figure 4:
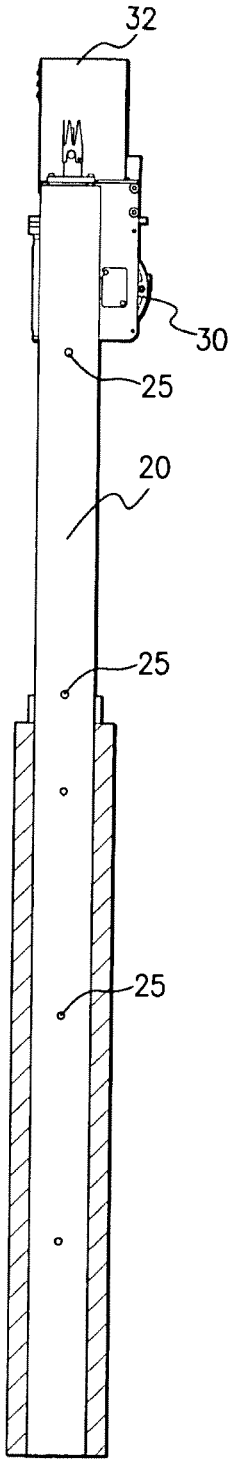
FIG. 4 is side view of the gate shown in FIG. 3.
Figure 4A:
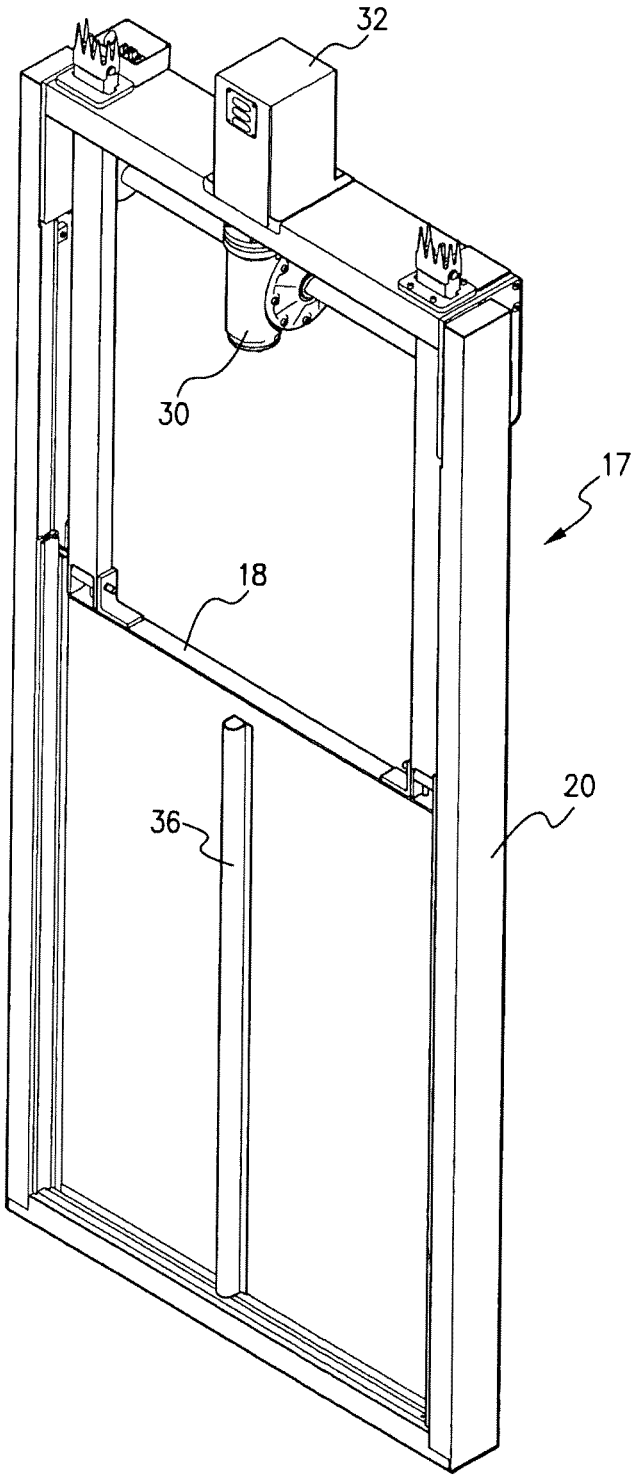
FIG. 4A is a similar view to that of FIG. 1 showing a variation of the positioning of the sensor assemblies.

In the embodiment previously described the sensor assemblies 44, 46 are located in gate leaf 18. The positioning of the sensor assemblies 44, 46 can be placed elsewhere. Longitudinal housings 36 (only one visible in FIG. 4A) may be affixed externally to both sides of gate leaf 18 and extend the height of gate leaf 18. The operation of control gate 17 will remain the same. The sensor assemblies can then be slidably located within housings 36. This variation can be viewed in Australian Patent Application No. 2009900439 which has been published with the specification of this application. The contents of Australian Patent Application No. 2009900439 have been previously incorporated herein.

In the embodiment shown in FIGS. 9 to 16 the positioning of the housings 36, 38 and their associated sensor assemblies 44, 46 have been integrated into the frame 20. The embodiment shows that the housings can be attached to the outer frame 21, the constraining frame 23 or a combination of both positions. For illustrative purposes both types of positioning have been shown. A downstream housing 100 and an upstream housing 102 are attached to constraining frame 23 whilst a downstream housing 104 and an upstream housing 106 are attached to outer frame 21. For accuracy it is preferred that a pair of upstream and downstream sensors are used as shown but a single upstream and single downstream sensor could also be used. Sensor assemblies 44 are slidably located within the downstream housings 100, 104 whilst sensor assemblies 46 are slidably located within upstream housings 102, 106.

Figure 2:
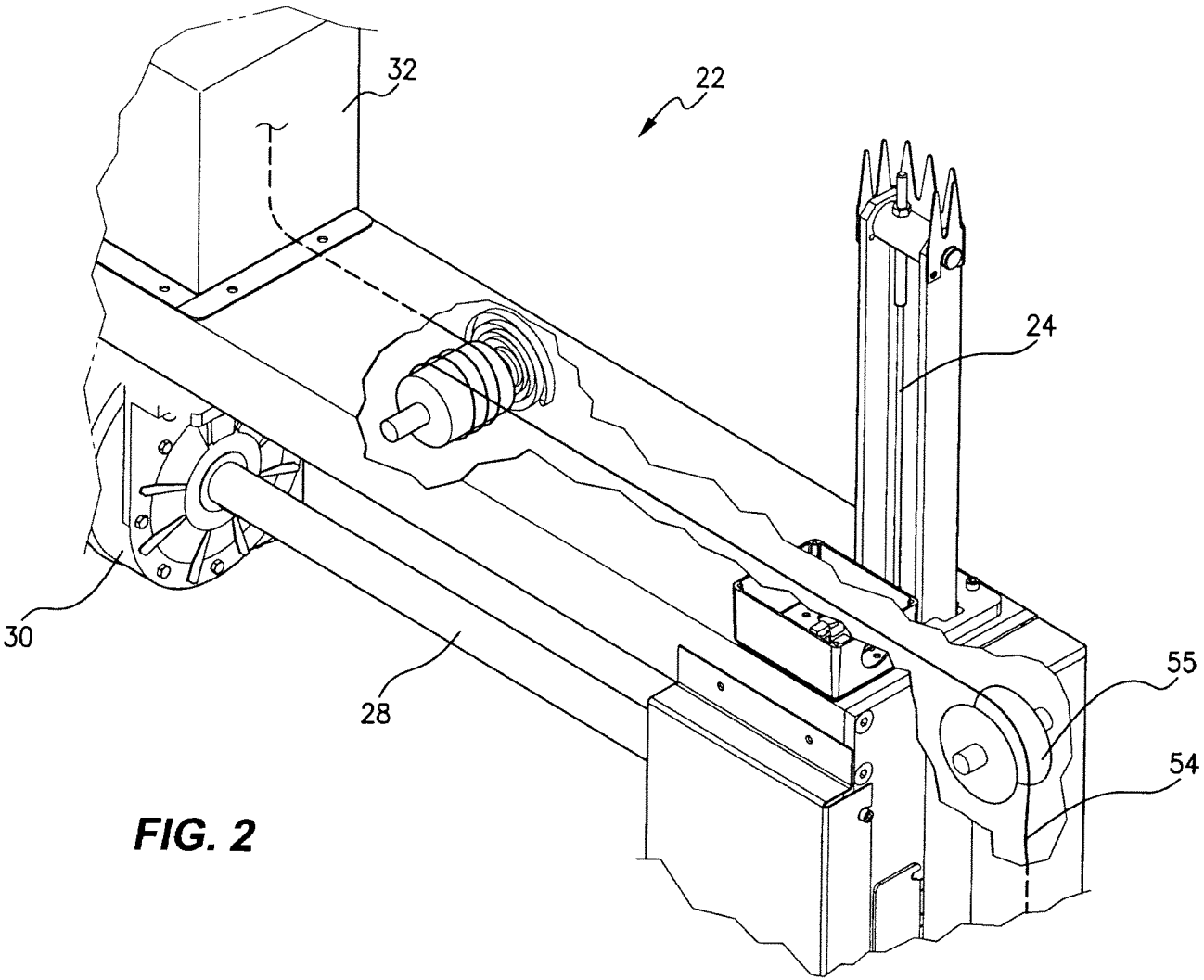
FIG. 2 is an enlarged partial view of the top of the gate shown in FIG. 1.
Figure 3:
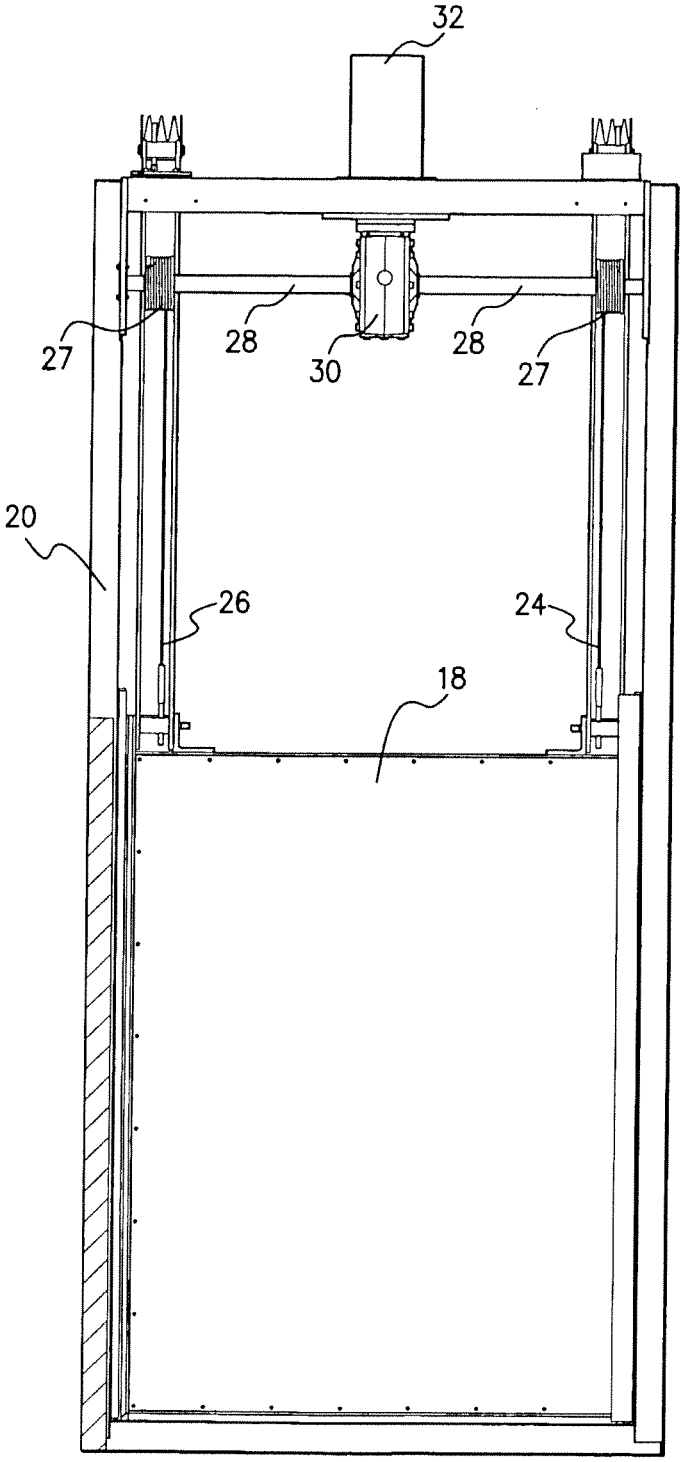
FIG. 3 is a front view of the gate shown in FIG. 1 without gate leaf slots.
Figure 15:
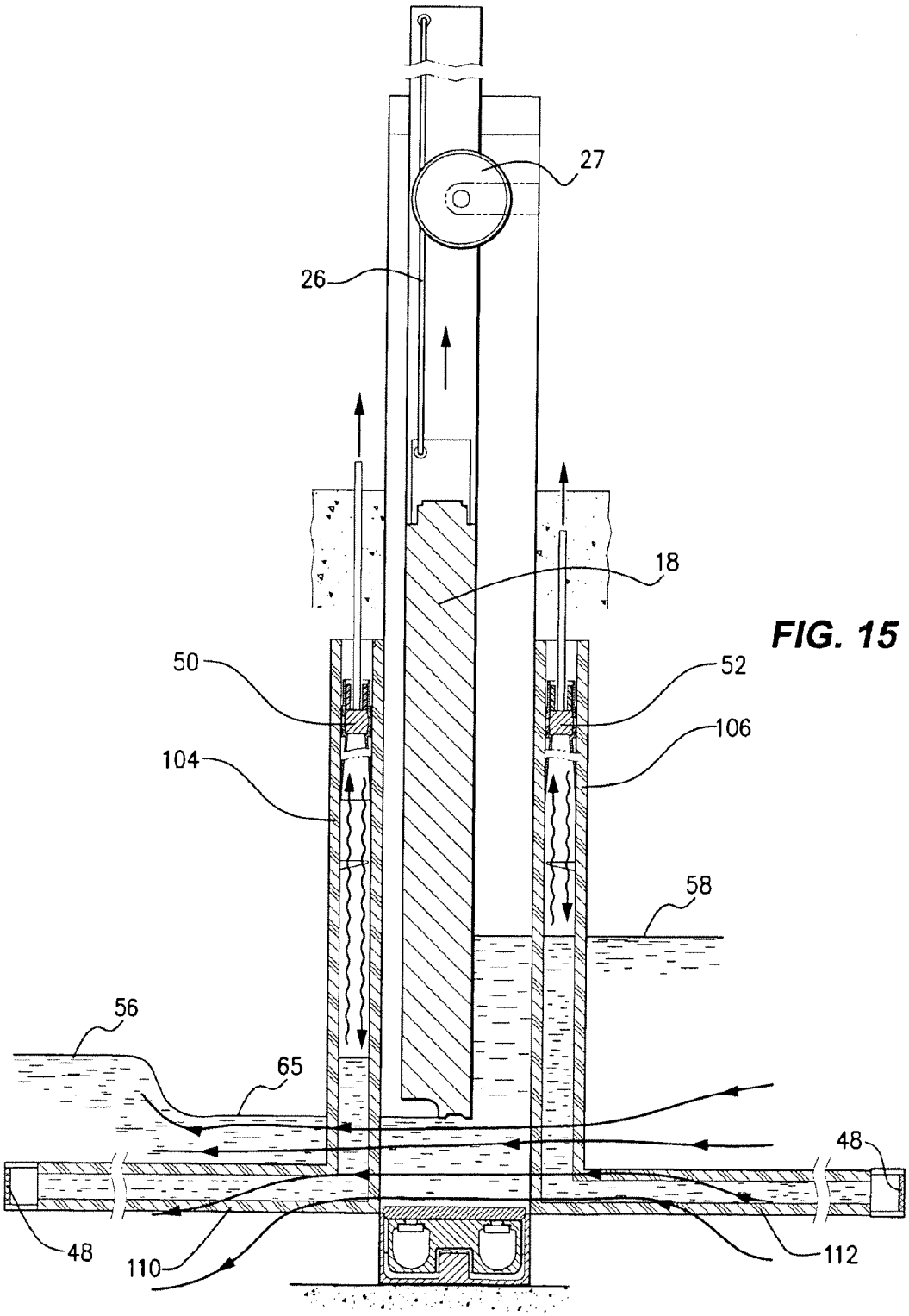
FIG. 15 is a longitudinal cross-sectional view of the operational aspect of the gate shown in FIG. 10 which includes an inlet tube for the sensor assemblies.
Figure 16:
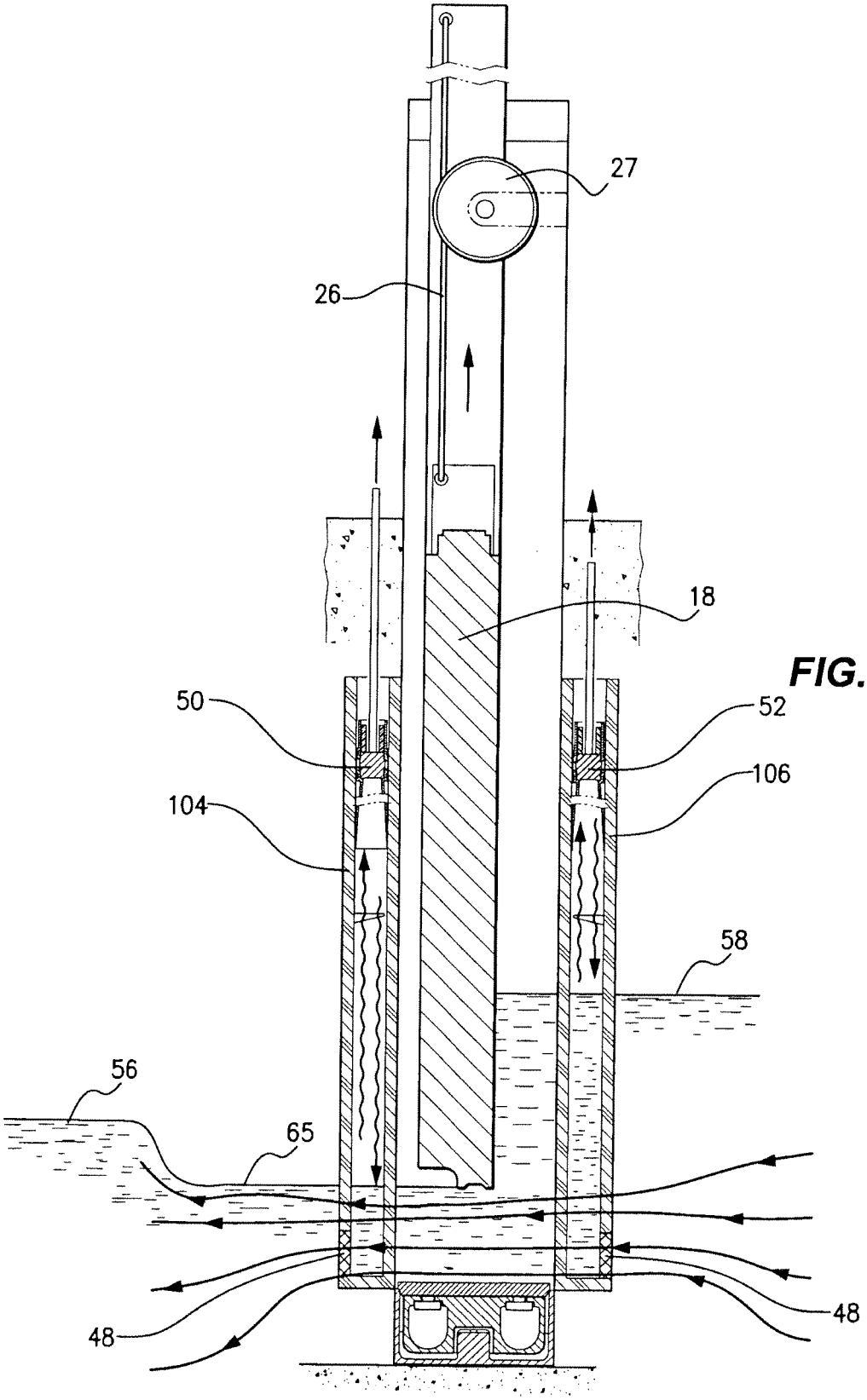
FIG. 16 is a longitudinal cross-sectional view of the operational aspect of the gate shown in FIG. 10 which does not include an inlet tube for the sensor assemblies.

In use, the water level measurement chambers located in housings 100, 102 on constraining frame 23 on opposite sides of gate leaf 18, have their sensor assemblies 44 and 46 measuring the water level at inlets 48 located in a non turbulent zone without disturbance from the fluid flow profile resulting from movement of water beneath gate leaf 18 as shown in FIG. 16. FIG. 16 shows that the levels 65 measured in downstream housings 100, 104 are less than the level 56 typically measured in view of the throttling effect of the exiting water. This variation can be corrected by the use of extension tubes 110, 112 opening into housings 100-106, as shown in FIG. 15. The sensor assemblies do not move with the gate leaf 18 and so the signal cable implementation using spring loaded pulley shown in FIGS. 1 and 2 is not required. The elevation of the ultrasonic transducers 50, 52 is precisely related to the elevation of the bottom surface of the constraining frame 23 to an accuracy better than ±0.5 mm by precision reference surfaces within the respective water level measurement chambers.

Similarly, where the water level measurement chambers are located in housings 104, 106 on the outer frame 21 forming a permanent part of the irrigation channel's civil construction, similar criteria apply Variations can be made to the embodiments to suit various environmental or design requirements. The sensor assemblies can be replaced by other types of sensors to measure the water level height. The shape of the inlets can be altered and other changes can be made in accordance with the design requirements for the particular installation.

The invention will be understood to embrace many further modifications as will be readily apparent to persons skilled in the art and which will be deemed to reside within the broad scope and ambit of the invention, there having been set forth herein only the broad nature of the invention and specific embodiments by way of example.

The invention claimed is:

1. A sluice gate comprising:

a gate leaf including an upstream face for an upstream side of an open channel, including a downstream face opposite the upstream face and for a downstream side of the open channel, and being movable to allow channel fluid flow from the upstream side to the downstream side;

an upstream chamber disposed in the gate leaf and coupled to receive an upstream chamber fluid flow from the upstream side of the open channel via an upstream chamber inlet, the upstream chamber inlet disposed on the upstream face at a first predetermined distance above a lower edge of the gate leaf, the upstream chamber inlet including an upstream flow filter to insulate the upstream chamber from upstream effects of the channel fluid flow, the upstream chamber adapted to house an upstream sensor for measuring upstream fluid-level information; and a downstream chamber disposed in the gate leaf and coupled to receive a downstream chamber fluid flow from the downstream side of the open channel via a downstream chamber inlet, the downstream chamber inlet disposed on the downstream face of the gate leaf at a second predetermined distance above the lower edge of the gate leaf, the downstream chamber inlet including a downstream flow filter to insulate the downstream chamber from downstream effects of the channel fluid flow, the downstream chamber adapted to house a downstream sensor for measuring downstream fluid-level information.

2. The sluice gate of claim 1 further comprising a frame adapted to be secured to the open channel, and adapted to be coupled to facilitate movement of the gate leaf, thereby allowing the channel fluid flow from the upstream side to the downstream side.

3. The sluice gate of claim 1 further comprising a controller configured to provide instructions to a vertical actuator to lower the gate leaf in a downward direction until the lower edge of the gate leaf substantially reaches a predetermined depth in channel fluid.

4. The sluice gate of claim 3 wherein the instructions to lower the gate leaf in the downward direction comprise instructions to:

initially raise the gate leaf in an upward direction until the lower edge of the gate leaf is substantially above the predetermined depth; and subsequently lower the gate leaf in the downward direction until the lower edge of the gate leaf substantially reaches the predetermined depth.

5. The sluice gate of claim 3 wherein the vertical actuator comprises a tensioned cable assembly, or a rack and pinion assembly.

6. The sluice gate of claim 1 wherein one or more of the upstream effects and the downstream effects comprise debris.

7. The sluice gate of claim 1 wherein one or more of the upstream effects and the downstream effects comprise turbulence.

8. The sluice gate of claim 1 wherein one or more of the upstream chamber inlet and the downstream chamber inlet is disposed in a substantially zero mean velocity fluid region of the channel fluid flow.

9. The sluice gate of claim 1 wherein the upstream chamber is configured to receive an upstream sensor housing, the upstream sensor housing adapted to house the upstream sensor and having an upstream housing inlet that, when the upstream sensor housing is received by the upstream chamber, is substantially aligned with the upstream chamber inlet, thereby allowing the channel fluid flow to the upstream sensor.

10. The sluice gate of claim 1 wherein the downstream chamber is configured to receive a downstream sensor housing, the downstream sensor housing adapted to house the downstream sensor and having a downstream housing inlet that, when the downstream sensor housing is received by the downstream chamber, is substantially aligned with the downstream chamber inlet, thereby allowing the channel fluid flow to the downstream sensor.

11. The sluice gate of claim 1 wherein the upstream chamber comprises an upstream seal disposed between the lower edge of the gate leaf and the first predetermined distance, the upstream seal being configured to substantially prevent entry of channel fluid to the upstream chamber through the lower edge of the gate leaf.

12. The sluice gate of claim 1 wherein the downstream chamber comprises a downstream seal disposed between the lower edge of the gate leaf and the second predetermined distance, the downstream seal being configured to substantially prevent entry of channel fluid to the downstream chamber through the lower edge of the gate leaf.

13. The sluice gate of claim 1 wherein the upstream chamber comprises a breather hole disposed above the lower edge of the gate leaf, the breather hole adapted to prevent an air lock from forming within the upstream chamber.

14. The sluice gate of claim 1 wherein the downstream chamber comprises a breather hole disposed above the lower edge of the gate leaf, the breather hole adapted to prevent an air lock from forming within the downstream chamber.

15. A method comprising:

positioning a gate leaf to allow channel fluid flow from an upstream side of an open channel to a downstream side of the open channel, the gate leaf including an upstream face for the upstream side and including a downstream face for the downstream side;

receiving, via an upstream inlet on an upstream chamber disposed on the upstream face at a first predetermined distance above a lower edge of the gate leaf, upstream chamber fluid flow from the upstream side of the open channel;

insulating, using an upstream flow filter on the upstream inlet, the upstream chamber from upstream effects of the channel fluid flow;

measuring, using an upstream sensor housed in the upstream chamber, upstream fluid-level information;

receiving, via a downstream inlet on a downstream chamber disposed on the downstream face at a second predetermined distance above the lower edge of the gate leaf, downstream chamber fluid flow from the downstream side of the open channel;

insulating, using a downstream flow filter on the downstream inlet, the downstream chamber from downstream effects of the channel fluid flow; and measuring, using a downstream sensor housed in the downstream chamber, downstream fluid-level information.

16. The method of claim 15 wherein positioning the gate leaf comprises providing instructions to lower the gate leaf in a downward direction until the lower edge of the gate leaf substantially reaches a predetermined depth in channel fluid.

17. The method of claim 16 wherein the instructions to lower the gate leaf in the downward direction comprise instructions to:

initially raise the gate leaf in an upward direction until the lower edge of the gate leaf is substantially above the predetermined depth; and subsequently lower the gate leaf in the downward direction until the lower edge of the gate leaf substantially reaches the predetermined depth.

18. The method of claim 15 wherein one or more of the upstream effects and the downstream effects comprise debris.

19. The method of claim 15 wherein one or more of the upstream effects and the downstream effects comprise turbulence.

20. A system comprising:

means for positioning a gate leaf to allow channel fluid flow from an upstream side of an open channel to a downstream side of the open channel, the gate leaf including an upstream face for the upstream side and including a downstream face for the downstream side;

means for receiving upstream chamber fluid flow from the upstream side of the open channel, the means for receiving the upstream chamber fluid flow disposed on the upstream face at a first predetermined distance above a lower edge of the gate leaf;

means for insulating the upstream chamber from upstream effects of the channel fluid flow;

means for measuring upstream fluid-level information;

means for receiving downstream chamber fluid flow from the downstream side of the open channel, the means for receiving the downstream chamber fluid flow disposed on the downstream face at a second predetermined distance above the lower edge of the gate leaf;

means for insulating the downstream chamber from downstream effects of the channel fluid flow; and means for measuring downstream fluid-level information.

21. A sluice gate comprising:

a gate leaf being movable to allow channel fluid flow from an upstream side of an open channel to a downstream side of the open channel; and a chamber disposed in the gate leaf and coupled to receive chamber fluid flow from one side of the open channel via an inlet, the inlet disposed on the one side at a predetermined distance above a lower edge of the gate leaf, the inlet including a flow filter to insulate the chamber from effects of the channel fluid flow, the chamber adapted to house a sensor for measuring fluid-level information.

* * * * *